US011207696B2

(12) United States Patent
Zhang

(10) Patent No.: US 11,207,696 B2
(45) Date of Patent: Dec. 28, 2021

(54) MAGNETIC DRUM SEPARATOR

(71) Applicant: Shujun Zhang, West Perth (AU)

(72) Inventor: Shujun Zhang, West Perth (AU)

( * ) Notice: Subject to any disclaimer, the term of this patent is extended or adjusted under 35 U.S.C. 154(b) by 97 days.

(21) Appl. No.: 16/900,239

(22) Filed: Jun. 12, 2020

(65) Prior Publication Data

US 2021/0276019 A1 Sep. 9, 2021

(30) Foreign Application Priority Data

Mar. 8, 2020 (AU) ..... 2020900710

(51) Int. Cl.

| | |
|---|---|
| ***B03C 1/03*** | (2006.01) |
| ***B03C 1/247*** | (2006.01) |
| ***B03C 1/032*** | (2006.01) |
| ***B03C 1/034*** | (2006.01) |

(52) U.S. Cl.

CPC ..... *B03C 1/247* (2013.01); *B03C 1/03* (2013.01); *B03C 1/032* (2013.01); *B03C 1/034* (2013.01)

(58) Field of Classification Search

CPC ..... B03C 1/247; B03C 1/103; B03C 1/032; B03C 1/034; B03C 1/0332; B03C 1/0335; B03C 1/14

See application file for complete search history.

(56) References Cited

U.S. PATENT DOCUMENTS 2,720,973 A * 10/1955 Gross ..... B01D 29/90 210/223
3,146,191 A * 8/1964 Greenwald ..... B03C 1/14 209/223.1
3,409,139 A * 11/1968 Kristofl ..... B01D 33/463 210/404
3,947,349 A 3/1976 Fritz
4,016,071 A 4/1977 Paterson
(Continued)

FOREIGN PATENT DOCUMENTS

CN 102172562 A 9/2011
CN 107744879 A 3/2018
(Continued)

OTHER PUBLICATIONS

International-type search for Australian Provisional Patent Application 2020900710.

*Primary Examiner* — Patrick H Mackey
(74) *Attorney, Agent, or Firm* — Carrier Blackman & Associates, P.C.; Fulchand P. Shende; Joseph P. Carrier

(57) ABSTRACT

A magnetic drum separator comprises a drum rotatable about an axis, the drum comprising an internal chamber and an opening at an end of the drum providing access into the internal chamber. The magnetic drum separator also comprises an inlet for supplying a liquid or granular substance into the internal chamber through the opening, a magnet outside of the drum for attracting magnetic material in the liquid or granular substance towards an internal sidewall of the internal chamber, a collection device for recovering magnetic material attracted to the internal sidewall and an annular seal member attached to the end of the drum that rotates with the drum in use. A baffle that bears against the annular seal member partially seals the opening. A plurality of cavities formed in the annular seal member receive fluid leaking into a boundary between the annular seal member and the baffle.

20 Claims, 4 Drawing Sheets

(56) References Cited

U.S. PATENT DOCUMENTS

| | | | | |
|---|---|---|---|---|
| 4,686,035 | A * | 8/1987 | Estabrook | B03C 1/10 209/219 |
| 4,874,508 | A | 10/1989 | Fritz | |
| 9,833,791 | B2 * | 12/2017 | Wang | B03C 1/23 |
| 2008/0164184 | A1 * | 7/2008 | Marston | B03C 1/14 209/219 |
| 2021/0016293 | A1 * | 1/2021 | Miles | B03C 1/26 |

FOREIGN PATENT DOCUMENTS

| | | | | |
|---|---|---|---|---|
| CN | 107812607 | A | * | 3/2018 |
| GN | 107812607 | A | | 3/2018 |
| WO | 95/23646 | A1 | | 9/1995 |

* cited by examiner

MAGNETIC DRUM SEPARATOR

CROSS-REFERENCE TO RELATED APPLICATIONS

The present application claims priority under 35 USC 119 based on Australian Provisional Patent Application No. 2020900710, filed on Mar. 8, 2020. The entire subject matter of this priority document, including specification claims and drawings thereof, is incorporated by reference herein.

FIELD

The present invention relates to mineral processing and, more particularly, to a magnetic drum separator.

BACKGROUND

Magnetic drum separators are used in mineral processing lines to remove iron particulates and other metal contaminants suspended in slurries. Drum separators can also be used to separate magnetic materials from non-magnetic materials combined in solid-based mixtures.

A magnetic drum separator typically comprises a hollow cylindrical drum that is rotated about an axis by an electric motor. A large magnetic (typically a permanent magnet) is arranged in the internal chamber of the drum that remains static relative to the drum. A substance comprised of magnetic and non-magnetic materials is fed towards the curved outer surface of the drum by a pipe, channel or similar conduit that extends from a feed hopper to the surface. A casing is arranged next to the drum that comprises an arc-shaped surface extending partially around the drum's curved surface. The casing is positioned a short distance away from the surface such that a curved channel is formed between the drum surface and casing.

Magnetic materials in the substance are pulled towards the outer surface of the drum by the stationary magnetic field of the internal magnet. As the drum rotates, the magnetic materials move with the drum's outer surface through the curved channel between the drum and the casing. The magnetic materials are carried around the drum to a collection point that is located near to an outer boundary of the magnetic field. The magnetic materials fall away from the drum via an outlet pipe or conduit arranged at the collection point. Nonmagnetic particles are discharged as tailings from a different position around the drum, which is normally towards its lowermost end.

Magnetic drum separators of this configuration have several problems. For example, coarse particles and debris can often get trapped between the surface of the drum and its outer casing which can impede the rotation of the drum and abrade and damage its surface. Coarse particles can also get trapped at the point at which the magnetic materials are collected and block the flow of such materials into the outlet pipe.

Further, because the magnet is disposed inside of the drum, if the magnet becomes loose, damaged or misaligned during use then it is difficult to detect and remedy these issues. It is also difficult to adjust the angular alignment of the magnet relative to the rotational axis of the drum. Further, because the magnetic materials and tailings are only retrieved from single locations around the drum, the processing capacity of the drum separator is limited.

In this context, there is a need for improved magnetic drum separators.

SUMMARY

According to the present invention, there is provided a magnetic drum separator, comprising:

a drum rotatable about an axis relative to a frame, wherein the drum comprises an internal chamber and an opening at an end of the drum that provides access into the internal chamber;

an inlet for supplying a liquid or granular substance into the internal chamber through the opening at the end of the drum;

a magnet arranged outside of the drum for attracting magnetic material comprised in the liquid or granular substance towards an internal sidewall of the internal chamber;

a collection device for recovering at least a proportion of the magnetic material attracted to the internal sidewall;

an annular seal member attached to the end of the drum, wherein the annular seal member rotates with the drum in use; and a baffle that bears against the annular seal member and partially seals the opening at the end of the drum, wherein a plurality of cavities are formed in the annular seal member, the cavities being adapted to receive fluid leaking into a boundary between the annular seal member and the baffle.

The annular seal member may comprise an inwardly facing circular wall, wherein the plurality of cavities are formed in the inwardly facing circular wall and the baffle comprises a rearmost portion that bears against the inwardly facing circular wall.

The rearmost portion of the baffle may be sloped downwardly towards the internal chamber.

The baffle may seal a lowermost section of the opening at the end of the drum.

The baffle may be dimensioned such that it seals a lowermost semicircular section of the opening at the end of the drum.

The baffle may comprise an outlet for extracting non-magnetic material comprised in the liquid or granular substance from the internal chamber.

The magnet may extend at least partially circumferentially around the axis along an arcuate path.

The arcuate path may extend from a start position to an end position and the collection device may collect magnetic material moved towards the end position by the drum.

The magnetic drum separator may comprise a water sprayer that sprays water onto the internal sidewall to move magnetic material from the internal sidewall into the collection device.

The end position may be disposed above the start position and the collection device is arranged underneath the end position in the internal chamber.

The collection device may comprise a trough.

The trough may be elongated and extend longitudinally along the axis.

The trough may slope downwardly towards the opening at the end of the drum.

The inlet may be adapted to carry a slurry into the internal chamber, and the drum may be dimensioned such that a slurry pool forms in a base of the internal chamber.

The inlet may comprise a pipe for carrying the slurry into the internal chamber.

The pipe may comprise an elongate slot extending longitudinally along the pipe, wherein the slurry flows out of the elongate slot towards the internal sidewall.

The pipe may comprise a channel in fluid communication with the elongate slot for directing the slurry from the elongate slot towards the internal sidewall.

The magnetic drum separator may comprise a pair of openings that provide access to the internal chamber from opposed ends of the drum.

The magnetic drum separator may comprise a pair of collection devices that collect the magnetic material from the opposed ends of the drum.

The magnetic drum separator may comprise a pair of water sprayers operatively configured to spray water onto the internal sidewall to move magnetic material from the internal sidewall into the pair of collection devices.

BRIEF DESCRIPTION OF DRAWINGS

Embodiments of the invention will now be described by way of example only with reference to the accompanying drawings, in which.

DESCRIPTION OF EMBODIMENTS

Figure 1:
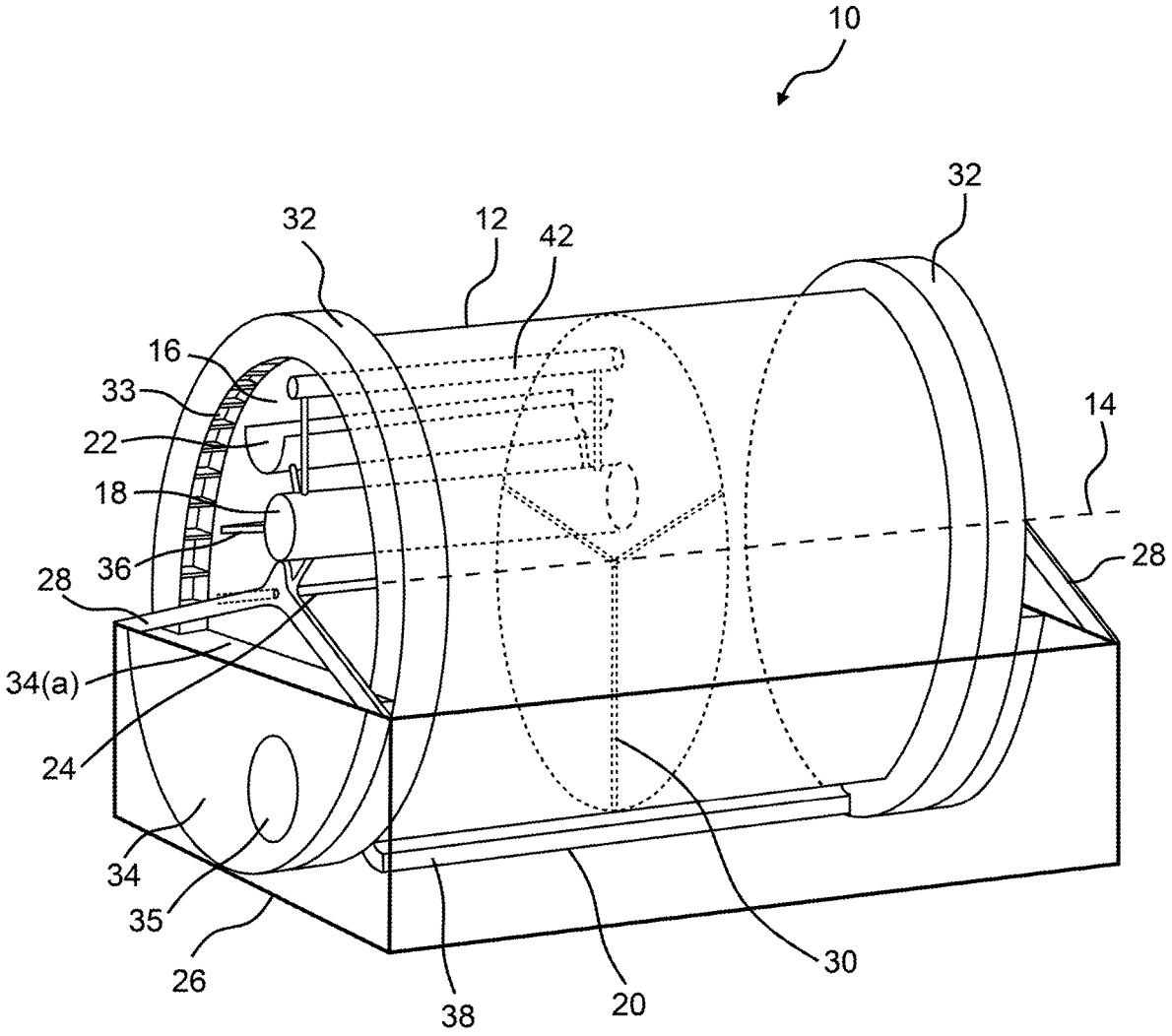
FIG. 1 is perspective view of a magnetic drum separator according to an example embodiment of the invention.
Figure 2:
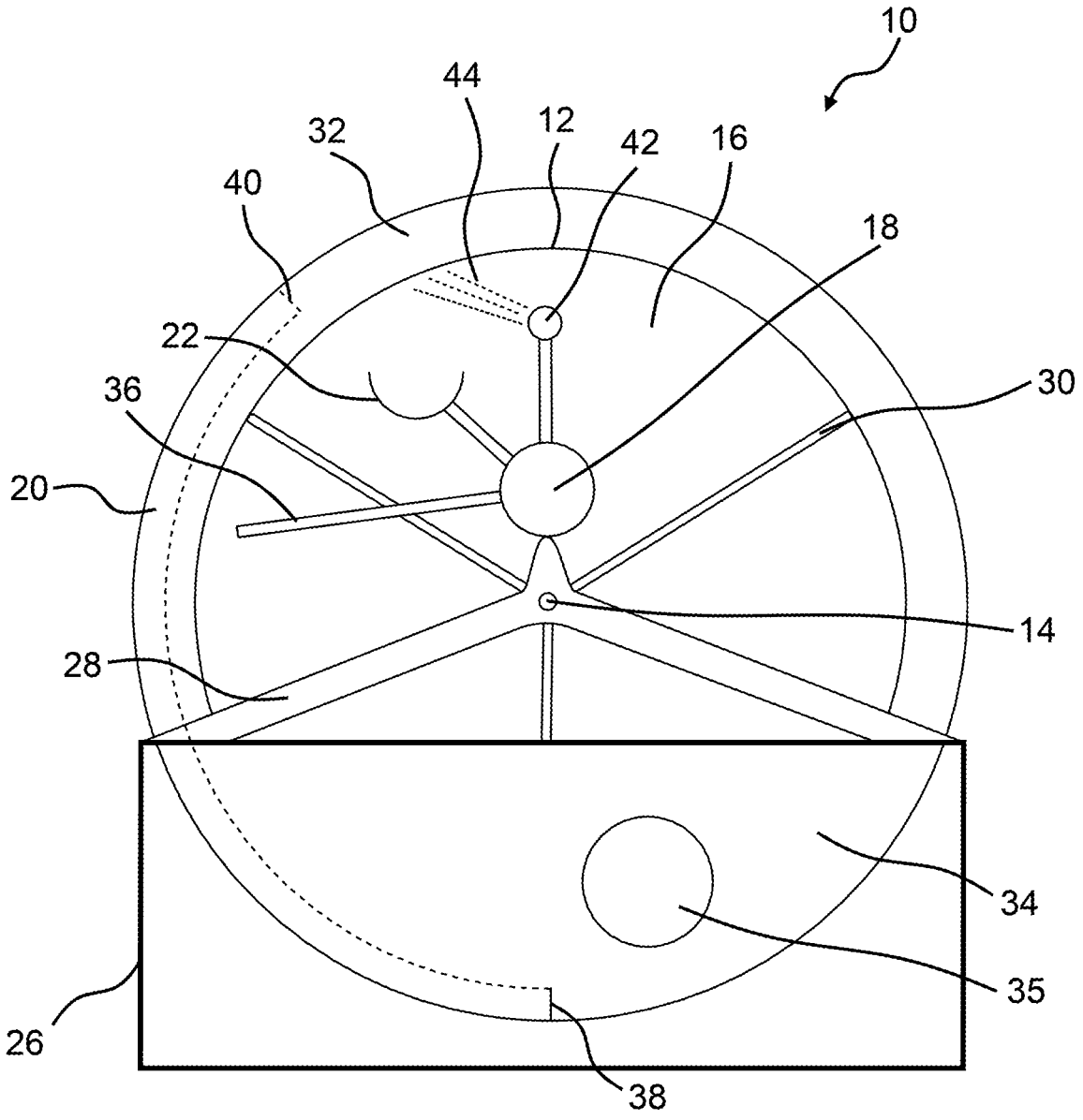
FIG. 2 is a front elevation of the magnetic drum separator.
Figure 3:
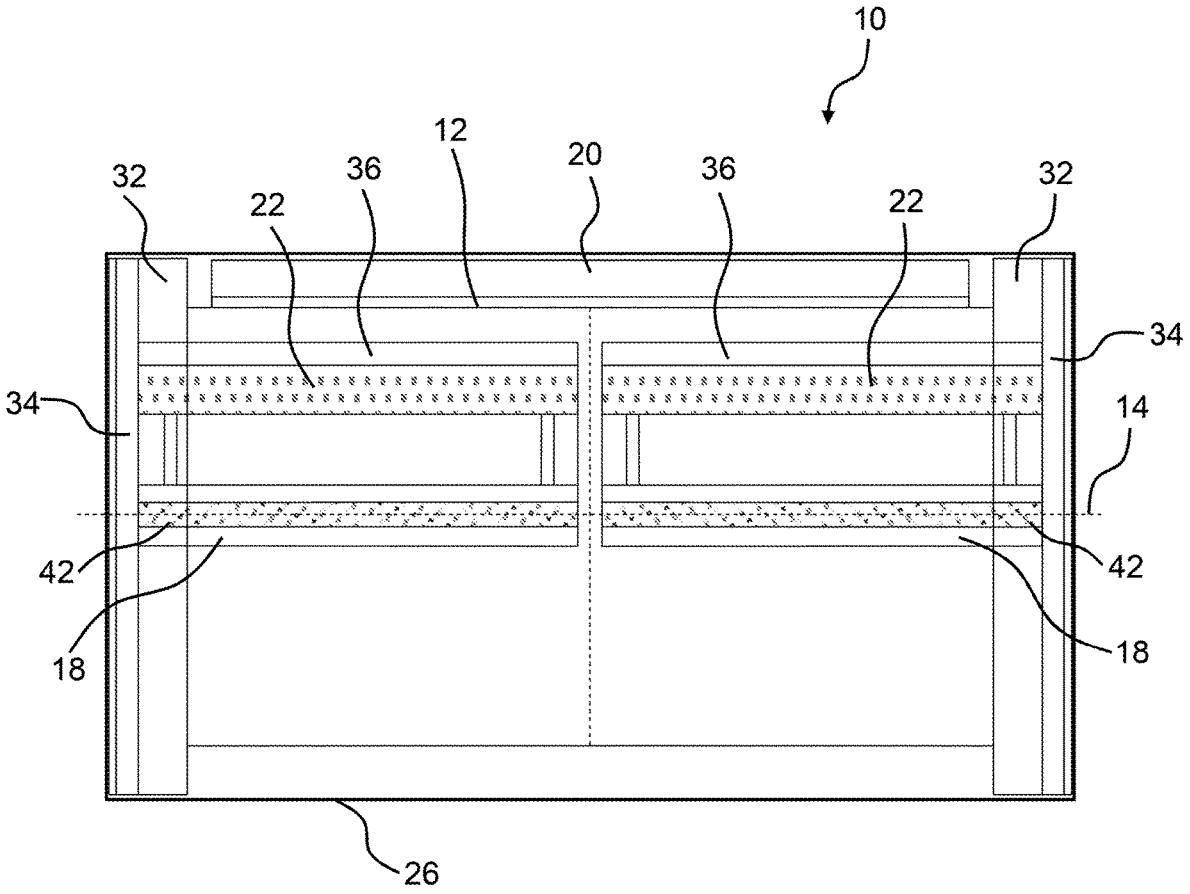
FIG. 3 is a plan view of the magnetic drum separator, wherein an internal chamber of the magnetic drum separator is shown partially in cross section.

Referring to FIGS. 1 to 3, an example embodiment of the present invention provides a magnetic drum separator 10 comprising a drum 12 rotatable about an axis 14, wherein the drum 12 comprises an internal chamber 16, an inlet 18 for supplying a liquid or granular substance into the internal chamber 16 and a magnet 20 arranged outside of the drum 12 for attracting magnetic material comprised in the substance towards an internal sidewall of the internal chamber 16. The magnetic drum separator 10 also comprises a collection device 22 that collects at least a proportion of the magnetic material attracted to the internal sidewall as the drum 12 rotates.

More particularly, in the example depicted the magnetic drum separator 10 is primarily adapted to separate magnetic materials that are comprised in slurries and similar fluid mixtures. For example, the magnetic drum separator 10 may be used to process a slurry comprised of iron contaminants suspended in water, as is commonly handled in mineral processing lines. In other examples, the magnetic drum separator 10 may be adapted to separate magnetic materials that are comprised in solid or granular substances, such as tramp iron mixed with rock particulates.

The drum 12 may comprise a hollow cylindrical vessel with an axle 24 extending longitudinally through a centre of the vessel aligned with its rotational axis 14. The axle 24 may be rotationally supported by a frame 26 of the magnetic drum separator 10. The frame 26 may comprise a rectangular chassis that has a pair of diagonally extending support arms 28 connected in a triangular arrangement at each end of the chassis. The two sets of support arms 28 may hold the axle 24 in a generally horizontal alignment.

The drum 12 may be secured to the axle 24 by a plurality of spokes 30 that radially extend away from the centre of the axle 24 to the internal sidewall of the chamber 16. The length of each spoke 30 matches the radius of the cylindrical cross-section of the chamber 16. The axle 24 and drum 12 may be rotated by an electric motor and gear assembly (not shown) that is connected to one or both ends of the axle 24. The drum 12 may be comprised of a non-ferromagnetic material, such as aluminium, that does not shield or influence the magnetic field of the magnet 20.

An annular seal member 32 may be provided at each end of the drum 12 that is axially aligned with the axle 24. Each seal member 32 may be statically fastened to the drum 12 (for example, it may be welded to the drum 12) so that the seal member 32 rotates with the drum 12 during use. The annular seal member 32 may comprise an inwardly facing circular wall that comprises a plurality of cavities 33 formed therein. The cavities 33 may comprise box-shaped recesses arranged at regular spaced intervals around the circular wall.

A semicircular baffle 34 may also be provided at each end of the drum 12. Each baffle 34 may partially seal the relevant end of the drum 12 such that an opening above the baffle 34 provides access to the internal chamber 16 from the outside of the drum 12. The baffle 34 may be attached fixedly to the frame 26 such that the drum 12 rotates relative to the baffle 34 during use. The baffle 34 bears against the rotating annular seal member 32 and ensures that a lowermost semicircular section of the end of the drum 12 remains fluidly sealed during use, thus prohibiting the egress of fluid out of the drum 12 from the internal chamber 16. In the example depicted, a rearmost portion 34(*a*) of the baffle 34 extends into the drum 12. The rearmost portion 34(*a*) may be semicircular in shape and comprise an outermost curved surface that bears against, and is flush with, the inwardly facing circular wall of the annular seal member 32. The entrances of the cavities 33 of the seal member 32 face into the boundary formed between the circular wall of the seal member 32 and outermost curved surface of the rearmost portion 34(*a*).

Each baffle 34 may comprise an outlet 35 for extracting non-magnetic materials comprised in the slurry that is supplied into the drum 12 via the inlet 18. The outlet 35 may comprise a circular aperture that is formed in the baffle 34 at a position that is outside the magnetic field of influence of the magnet 20.

The inlet 18 may be a conduit comprising an elongate pipe extending from the opening at the end of the drum 12 inwardly into the internal chamber 16. The pipe 18 may extend through the chamber 16 and terminate at a position that is substantially at a centre of the chamber 16. In use, slurry may be directed into the pipe 18 under pressure using a pump and hose arrangement (not shown) connected to the inlet end of the pipe 18 at the open end of the drum 12. The pipe 18 may comprise an elongate slot extending longitudinally along the pipe 18 from which pressurised slurry may flow evenly away from the pipe 18 towards the internal sidewall of the drum 12. A channel member 36 may be attached to the pipe 18 that is in fluid communication with the elongate slot that carries the slurry towards the sidewall. The channel member 36 may comprise a rectangular chute that is arranged perpendicularly to the circumferential surface of the pipe 18. The chute 36 may comprise an internal aperture that extends through the chute 36 from a side of the chute 36 facing the elongate slot of the pipe 18 to an opposite side of the chute 36 facing the internal sidewall. The pipe 18 may be attached to the support arms 28 of the frame 26 by one or more struts which hold the pipe 18 in a stationary position as the drum 12 rotates.

The magnet 20 may comprise an arcuate body made of a ferromagnetic material that extends at least partially circumferentially around the axis 14. The magnet 20 may comprise a permanent magnet that is attached fixedly to the frame 26 which keeps the magnet 20 held stationary as the drum 12 rotates. In other examples, the magnet 20 may comprise an electromagnet. As best shown in FIG. 2, the magnet 20 may be arranged such that the arcuate path of its body extends approximately 135° degrees around the axis 14 from a start position 38 to an end position 40. The start position 38 may be disposed directly underneath the lowermost point of the drum 12 and the end position 40 may be arranged above the start position 38 to one side of the drum 12. In this arrangement, the magnet 20 causes magnetic material comprised in the slurry that flows into the internal chamber 16 via the chute 36 to be pulled towards the rotating internal sidewall of the chamber 16 and subsequently moved up towards the end position 40 by the sidewall.

In other examples, the arcuate path of the magnet 20 may extend around the axis 14 by a different number of degrees. Preferably, the path may extend at least 100° degrees around the axis 14 from the start position 38 to the end position 40. It will be understood that, more generally, the position and angular orientation of the magnet 20 relative to the drum 12 may be adjusted so that its magnetic field is suited to the operating parameters of the magnetic drum separator 10, including in relation to the particular type of slurry or substance that is supplied to the magnetic drum separator 10. For example, the position and/or angular orientation may be adjusted in order to suit the average viscosity, composition, density and weight of the input substance, or to suit the required operating speed and throughput processing capacity of the magnetic drum separator 10.

The collection device 22 may be a trough comprising an elongate receptacle that is substantially semicircular in cross section and extends longitudinally through the internal chamber 16. More particularly, the trough 22 may be disposed in the internal chamber 16 such that its longitudinal axis is arranged underneath a position in the chamber 16 that is proximal to the end position 40. In this arrangement, the trough 22 collects magnetic material that is moved up towards the end position 40 by the drum 12 and that subsequently falls away from the internal sidewall by gravity. The trough 22 may be attached to the pipe 18 by one or more struts which keep the trough 22 stationary as the drum 12 rotates. The trough 22 may be oriented such that its longitudinal axis gently slopes down towards the open end of the drum 12. Magnetic material falling into the trough 22 is, therefore, caused to flow along the trough 22 under gravity towards the open end of the chamber 16 so that it can be extracted from the drum 12.

The magnetic drum separator 10 may also comprise a water sprayer 42 disposed inside the drum 12 that sprays a jet of water 44 onto the internal sidewall of the drum 12. The jet of water 44 helps to remove magnetic material from the internal sidewall so that the material is deposited effectively into the trough 22. The water sprayer 42 may comprise an elongate conduit that extends from the opening at the end of the drum 12 inwardly into the internal chamber 16. The conduit 42 may be arranged above the inlet pipe 18 and terminate at a position that is substantially at a centre of the chamber 16. The conduit 42 may be attached to the inlet pipe 18 by one or more struts which keep the conduit 42 stationary as the drum 12 rotates. Water may be directed into the conduit 42 under pressure using a pump and hose arrangement (not shown) that connect to an inlet end of the conduit 42 at the open end of the drum 12. The conduit 42 may comprise an elongate slot extending longitudinally along a side of conduit 42 from which, in use, a pressurised jet of water is ejected towards the internal sidewall of the drum 12.

Referring to FIG. 3, in the example depicted the magnetic drum separator 10 comprises a pair of the inlet pipes 18. The pipes 18 are arranged symmetrically and allow slurry to be fed into the internal chamber 16 from both ends of the drum 12. A pair of the troughs 22 are also provided that enable magnetic material comprised in the slurry to be collected from both ends of the drum 12. A pair of water sprayers 42 are also provided that spray two pressurised jets of water 44 onto the internal sidewall of the drum 12 to help move the magnetic material into the troughs 22.

In use, the drum 12 rotates about its axis 14 and a slurry may be fed into the internal chamber 16 via the pair of inlet pipes 18. The slurry flows evenly out towards the internal sidewall of the chamber 16 via the rectangular chutes 36 that outwardly extend from the inlet pipes 18. Magnetic material comprised in the slurry is pulled towards the internal sidewall by the magnet 20 and is then lifted up towards the collection troughs 22 by the travelling sidewall. When the material has moved to a position around the axis 14 where the magnetic field strength of the magnet 20 is negligible, the water jets emitted from the water sprayers 42 spray the magnetic material off from the sidewall and into the troughs 22. The magnetic material then flows along the downwardly sloped troughs 22 towards their outermost ends so that the material can be retrieved from the drum 12.

Any magnetic material that is not deposited into the troughs 22 falls to the bottom of the drum 12 and forms a pool. The magnetic material in the slurry pool gets pulled back towards the internal sidewall of the drum 12 by the magnet 20 and is, therefore, advantageously reprocessed. Any tailings comprised in the slurry that are not attracted towards the magnet 20 (or are attracted by a negligible force only) remain at the bottom of the drum 12 in the slurry pool. The unwanted tailings can be extracted from the drum 12 via the two circular openings 35 provided in the baffles 34.

Each baffle 34 bears against the relevant annular seal member 32 and serves to seal the end of the drum 12 to stop fluid from leaking out. In event that any fluid seeps into the boundary between the baffle 34 and the relevant annular seal member 32, the fluid flows into one or more of the cavities 33 in the inwardly facing circular wall of the seal member 32. The fluid that is collected in the cavities 33 is carried in a circular path upwardly towards the top end of the drum 12. Eventually, the fluid flows out of the cavities 33 and falls back into internal chamber 16 of the drum 12. The rearmost portion 34(*a*) of the baffle 34 may be sloped downwardly towards the internal chamber 16 so that any fluid falling onto the rearmost portion 34(*a*) flows back into the chamber 16.

The magnetic drum separator 10 enables the magnetic and non-magnetic materials comprised in the slurry to be separated from each other in a fast and efficient manner. The magnetic drum separator 10 advantageously avoids the problems associated with coarse particles and debris that can get blocked in drum separators that use internally mounted magnets. Further, because the magnet 20 is arranged on the outside of the drum 12, if the magnet 20 becomes loose, damaged or misaligned during use then it is advantageously easy to detect and remedy these issues. It is also advantageously simple to adjust the angular alignment of the magnet 20 relative to the rotational axis 14 of the drum 12. Further, because the magnetic materials and tailings are retrieved from locations 22, 35 at both ends of the drum 12, the maximum processing capacity of the drum separator is substantially double the processing capacity that can be achieved when using drum separators that have internally mounted magnets. The cavities 33 in the annular seal members 32 advantageously remove any liquid that inadvertently seeps into the boundaries between the seal members 32 and baffles 34. This liquid is recovered and transferred back into the internal cavity 16 by the cavities 33 so that it can be reprocessed.

Figure 4:
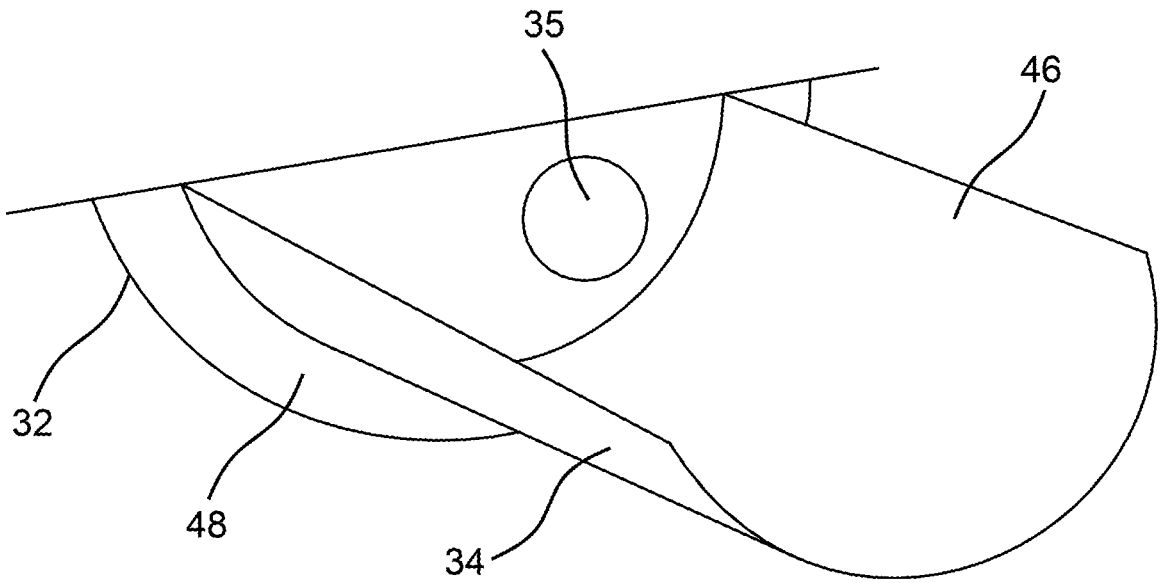
FIG. 4 is a partial perspective view of a baffle included in a magnetic drum separator according to a further example embodiment of the invention.

Referring to FIG. 4, in other examples the baffle 34 may comprise a first section 46 joined to a second section 48. The first section 46 may comprise a trough that is semicircular in cross section and extends away from the drum 12. A rearmost semicircular section of the trough 46 (not shown) may extend into the central aperture of the annular seal member 32 and bear against the inwardly facing circular wall of the seal member 32. The rearmost portion may be flush with the circular wall such that it seals the boundary between the rearmost portion and circular wall (and, therefore, the interface between the seal member 32 and baffle 34 generally). The second section 48 may comprise a ring-shaped collar that extends circumferentially around the semicircular trough 46. The collar 48 may be flat and bear against the frontmost annular face of the seal member 32. The collar 48 also serves to seal the interface between the seal member 32 and baffle 34.

Embodiments of the present invention provide magnetic drum separators that are useful for separating magnetic materials comprised in liquid slurries and solid-based mixtures and substances.

For the purpose of this specification, the word "comprising" means "including but not limited to", and the word "comprises" has a corresponding meaning. It is to be understood that, if any prior art is referred to herein, such reference does not constitute an admission that the prior art forms a part of the common general knowledge in the art, in Australia or any other country.

The above embodiments have been described by way of example only and modifications are possible within the scope of the claims that follow.

The invention claimed is:

1. A magnetic drum separator, comprising:

a drum rotatable about an axis relative to a frame, wherein the drum comprises an internal chamber and an opening at an end of the drum that provides access into the internal chamber;

an inlet for supplying a liquid or granular substance into the internal chamber through the opening at the end of the drum;

a magnet arranged outside of the drum for attracting magnetic material comprised in the liquid or granular substance towards an internal sidewall of the internal chamber;

a collection device for recovering at least a proportion of the magnetic material attracted to the internal sidewall;

an annular seal member attached to the end of the drum, wherein the annular seal member rotates with the drum in use; and a baffle that bears against the annular seal member and partially seals the opening at the end of the drum, wherein a plurality of cavities are formed in the annular seal member, the cavities being adapted to receive fluid leaking into a boundary between the annular seal member and the baffle.

2. The magnetic drum separator according to claim 1, wherein the annular seal member comprises an inwardly facing circular wall, wherein the plurality of cavities are formed in the inwardly facing circular wall and the baffle comprises a rearmost portion that bears against the inwardly facing circular wall.

3. The magnetic drum separator according to claim 2, wherein the rearmost portion of the baffle is sloped downwardly towards the internal chamber.

4. The magnetic drum separator according to claim 1, wherein the baffle seals a lowermost section of the opening at the end of the drum.

5. The magnetic drum separator according to claim 4, wherein the baffle is dimensioned such that it seals a lowermost semicircular section of the opening at the end of the drum.

6. The magnetic drum separator according to claim 1, wherein the baffle comprises an outlet for extracting non-magnetic material comprised in the liquid or granular substance from the internal chamber.

7. The magnetic drum separator according to claim 1, wherein the magnet extends at least partially circumferentially around the axis along an arcuate path.

8. The magnetic drum separator according to claim 7, wherein the arcuate path extends from a start position to an end position and the collection device collects magnetic material moved towards the end position by the drum.

9. The magnetic drum separator according to claim 8, wherein the magnetic drum separator comprises a water sprayer that sprays water onto the internal sidewall to move magnetic material from the internal sidewall into the collection device.

10. The magnetic drum separator according to claim 8, wherein the end position is disposed above the start position and the collection device is arranged underneath the end position in the internal chamber.

11. The magnetic drum separator according to claim 10, wherein the collection device comprises a trough.

12. The magnetic drum separator according to claim 11, wherein the trough is elongated and extends longitudinally along the axis.

13. The magnetic drum separator according to claim 12, wherein the trough slopes downwardly towards the opening at the end of the drum.

14. The magnetic drum separator according to claim 1, wherein the inlet is adapted to carry a slurry into the internal chamber, and the drum is dimensioned such that a slurry pool forms in a base of the internal chamber.

15. The magnetic drum separator according to claim 14, wherein the inlet comprises a pipe for carrying the slurry into the internal chamber.

16. The magnetic drum separator according to claim 15, wherein the pipe comprises an elongate slot extending longitudinally along the pipe, wherein the slurry flows out of the elongate slot towards the internal sidewall.

17. The magnetic drum separator according to claim 16, wherein the pipe comprises a channel in fluid communication with the elongate slot for directing the slurry from the elongate slot towards the internal sidewall.

18. The magnetic drum separator according to claim 1, wherein the magnetic drum separator comprises a pair of openings that provide access to the internal chamber from opposed ends of the drum.

19. The magnetic drum separator according to claim 18, wherein the magnetic drum separator comprises a pair of collection devices that collect the magnetic material from the opposed ends of the drum.

20. The magnetic drum separator according to claim 19, wherein the magnetic drum separator comprises a pair of water sprayers operatively configured to spray water onto the internal sidewall to move magnetic material from the internal sidewall into the pair of collection devices.

* * * * *